United States Patent [19]

Guse

[11] 4,244,521

[45] Jan. 13, 1981

[54] ARRANGEMENT FOR DISCHARGING LIQUID MEDIUM UNDER HIGH PRESSURE

[75] Inventor: Kuno Guse, Dortmund, Fed. Rep. of Germany

[73] Assignee: Bochumer Eisenhuette Heintzmann GmbH & Co., Bochum, Fed. Rep. of Germany

[21] Appl. No.: 12,110

[22] Filed: Feb. 14, 1979

[30] Foreign Application Priority Data

Apr. 1, 1978 [DE] Fed. Rep. of Germany ..... 2814165

[51] Int. Cl.[3] ..... B05B 1/00; E21B 7/18

[52] U.S. Cl. ..... 239/110; 175/422; 239/596; 239/600; 285/110; 285/390

[58] Field of Search ..... 239/110, 589, 596, 600, 239/601, 602; 285/110, 333, 334, 356, 390; 175/67, 422; 299/17

[56] References Cited

U.S. PATENT DOCUMENTS

| | | | |
|---|---|---|---|
| 695,066 | 3/1902 | MacClain et al. | 285/333 |
| 2,893,759 | 7/1959 | Blose | 285/334 |
| 3,756,106 | 9/1973 | Chadwick et al. | 239/601 X |
| 4,150,794 | 4/1979 | Higgins | 239/600 X |

*Primary Examiner*—Andres Kashnikow

*Attorney, Agent, or Firm*—Michael J. Striker

[57] ABSTRACT

An arrangement for discharging liquid medium under a high pressure from a feed pipe having a tubular end portion, includes a jet support with a jet. The jet support is installed inside the tubular end portion of the feed pipe. The jet support has an inlet, an outlet and passages which connect the inlet to the outlet and are so formed and shaped as to increase the pressure of the liquid medium as the same exits the arrangement through the outlet. The jet support is screwed into the tubular end portion of the feed pipe and sealingly connected thereto.

27 Claims, 5 Drawing Figures

ARRANGEMENT FOR DISCHARGING LIQUID MEDIUM UNDER HIGH PRESSURE

BACKGROUND OF THE INVENTION

The present invention relates to an arrangement for discharging liquid medium under a high pressure from a feed pipe having a tubular end portion.

It is known in the prior art to use such an arrangement for extraction of minerals such as rock, coal, etc. The arrangement may be used alone for this purpose of in combination with a mechanical cutting tool such as a chisel.

One of the specific features of such an arrangement resides in supplying liquid medium (e.g. water) under an extremely high pressure, i.e., up to many thousand bars, through a jet. Thus, should the arrangement be located adjacent to the surface to be cut the high pressure water jet becomes extremely efficient for mining purposes. It is known to use a jet made of sapphire or diamond in form of a plate disc with a very small throughgoing hole. The outlet hole is advantageously smaller than 1 mm in cross-section, and preferably between 0.2 and 0.8 mm. The jet is mounted in a jet holder which in its turn is fixed in a jet support which has an inner recess so shaped as to increase the pressure of the liquid medium considerably even before the same enters the jet. In this case the jet tends to additionally and utmostly increase the speed (i.e., pressure) of the turbulent stream of the liquid medium. Thus, if the liquid medium pressure is 3000 bar and the cross-sectional dimension of the jet outlet is 0.3 mm the speed of the liquid medium exiting the arrangement is above 700 m/sec and the liquid medium discharge (i.e., water consumption) increases up to 3.2 l/min. It is also possible to increase these numbers even further if the liquid medium pressure is correspondingly increased and the cross-sectional dimension of the jet outlet is decreased to 0.2 mm. The kinetic energy of the exiting high pressure water jet is so great that with its help and depending upon the actual rock resistance (i.e., density) the rock surface tends to crack and form splits or breaks with a depth up to 30 mm.

The purpose of the arrangement is to cut with a high-pressure waterjet concentric annular splits in the rock surface of a drift (i.e., a driving gallery). The rock medium located between the splits is withdrawn by a rock drill (e.g., annular drill, mortising drill, etc.). Thus, when the arrangement for discharging the liquid medium under a high pressure is combined with a mechanically operated cutting tool the extraction is considerably facilitated; therefore the extraction productivity may be correspondingly increased. In order to obtain the best possible extraction results the liquid medium jet has to be located immediately adjacent to the mechanically operated cutting tool and as close to the surface to be cut as possible. Due to such arrangement of the high-pressure water jet it becomes possible to utilize so-called hydraulic "wedge effect", so that the high pressure water enters small fissures and cracks which are developed on the surface to be cut by the cutting tool simultaneously with advancing of the tool into these fissures and cracks. In other words the high pressure water jet considerably facilitates the advancement of the cutting tool into the surface to be cut.

Since the best possible effect of the high pressure water jet is achieved when the latter is located immediately adjacent to the surface to be cut (that is at the surface which is cut by the chisel during its working strokes), it is desirable to locate the high pressure water jet in front of the cutting tool (i.e., chisel) and before the surface to be cut or, depending upon the desirable eventual result, directly on the chisel with the jet directed forward towards the surface to be cut.

It has been recognized, however, that due to extremely high pressure of the liquid medium it is quite difficult to manufacture the jet with sufficiently small cross-sectional dimensions so as to be able to install the jet on corresponding grooves provided immediately on the face edge of the chisel or on the chisel itself in order to facilitate and increase the extraction productivity.

It is known in the prior art to provide a jet with a connecting coupling for detachably connecting the jet to a feed pipe. The jet projects outwardly beyond the feed pipe. The feed pipe itself due to the high pressure of the liquid medium has to have relatively thick wall. If it is desired to maintain the outlet hole of the jet, for example, 0.3 mm then the cross-sectional dimension of the feed pipe with the connecting coupling (i.e., for connecting the jet to the feed pipe) constitutes about 0.3 mm. Obviously, it is quite difficult to locate the jet having the overall cross-sectional dimension of 30 mm immediately adjacent to the surface to be cut, as is required in order to obtain the best extraction results. It is almost impossible to install such a jet arrangement on the recess provided on the chisel. Therefore, it is impossible to supply pressure water jet directly into the fissures and cracks in the surface to thereby advantageously utilize the above mentioned hydraulic "wedge effect".

However, if the high-pressure water jet is not located immediately to the surface to be cut, then its efficiency in facilitating the extraction process is considerably limited.

SUMMARY OF THE INVENTION

It is a general object of the present invention to avoid the disadvantages of the prior art arrangements for discharging liquid medium under a high pressure from a feed pipe having a tubular end portion.

More particularly, it is an object of the present invention to provide an arrangement for discharging liquid medium under the high pressure of many thousand bars, which arrangement has means of relatively small outer cross-section for connecting a jet to the tubular end portion of the feed pipe.

Another object of the present invention resides in providing such an arrangement which has almost half as small overall outer cross-sectional dimension as opposed to the conventional arrangements for discharging liquid medium under a high pressure.

Still another object of the present invention is to provide means for connecting the jet (i.e. jet holder) to the feed pipe so that the jet may be changed (i.e., withdrawn from the arrangement) at any time in a simple and reliable manner.

A further object of the present invention is to provide such an arrangement for discharging liquid medium at a high pressure, which can be mounted right on a cutting tool (i.e., chisel) so that the jet outlet is located immediately adjacent to the surface to be cut.

Still a further object of the present invention resides in providing an arrangement which can be fixed right on the chisel so that the high-pressure liquid medium exiting the jet exerts a hydraulic wedge effect on fissures and cracks in the surface to be cut so as to on the one hand efficiently facilitate the extraction process and on the other hand increase the extraction productivity.

In pursuance of these objects and others which will become apparent hereafter, one feature of the present invention resides in providing an arrangement for discharging liquid medium under a predetermined high pressure from a feed pipe having a tubular end portion with jet means adapted to be installed inside a tubular end portion of a feed pipe and having an inlet, an outlet spaced from said inlet and passage means which connect said inlet with said outlet. The passage means are adapted to increase the pressure of the liquid medium to a predetermined high pressure as the liquid medium exits said jet means through said outlet thereof.

The arrangement is further provided with connecting means rceivable in the tubular end portion of the feed pipe and engageable therewith for sealingly installing said jet means inside said tubular end portion.

The jet means in accordance with the preferred embodiment of the present invention include a jet and a jet holder for holding said jet having a jet outlet. The jet holder is mounted in a jet support which may be of one piece or of many pieces (e.g. two pieces) The jet support is detachably mounted in the tubular end portion of the feed pipe. The jet support further includes a leading end and a trailing end axially spaced from said leading end. The trailing end of the jet support is provided with the jet holder having said jet. The leading end portion is provided with outer cylindrical smooth circumference which is received in the inner cylindrical circumference of the tubular end portion of said feed pipe without any radial clearance. The leading end portion of the jet support is provided with an axial recess which has a funnel-shaped cross-section. The recess converges towards the trailing end of said jet support from said leading end thereof, that is the recess broadens towards the leading end of the jet support. The tubular end portion of the feed pipe is provided with a circumferential recess of a predetermined length. At the end of said circumferential recess there is located an inner annular circumferential shoulder operative to engage the leading end face of said jet support when the latter is inserted into the tubular end portion of the feed pipe. Thus, when the leading end face of the jet support abuts the annular circumferential shoulder of said tubular end portion of the feed pipe any further axial movement of the jet support inside the feed pipe is eliminated. The trailing end portion of the jet support is provided with an outer thread portion which engages the inner thread portion provided on the inner front part of the tubular end portion of the feed pipe. The inner thread portion is located forwardly relative to said circumferential shoulder it viewed in a direction of liquid medium flowing in the feed pipe. Thus, the jet support is screwed into the tubular end portion of the feed pipe until the leading end face of the jet support abuts said inner circumferential shoulder of the feed pipe.

In accordance with the present invention the connecting means (i.e. inner and outer thread portions on the feed pipe and on the jet support, respectively) are completely receivable in the tubular end portion of the feed pipe. In other words, the overall outer cross sectional dimension of the arrangement when the jet support is received in the tubular end portion of the feed pipe is stipulated only by the outer cross-sectional dimension of the tubular end portion of the feed pipe, i.e. no other element of the jet support or of the connecting means projects radially outwardly relative to the outer circumference of the tubular end portion of the feed pipe.

It is to be understood in this context that the prior art arrangements for this purpose teach a jet support which is connected to the tubular end portion of the feed pipe by an outer sleeve unit (e.g. screw cap) which is located outside the tubular end portion of the feed pipe. The tubular end portion of the feed pipe is provided with an outer thread engageable with an inner thread of said screw cap which is also connected (e.g., screwed on) to the jet support. In the case of the prior art arrangement the outer cross-sectional dimension of the screw cap stipulates the overall outer cross-sectional dimension of the arrangement. Obviously, the outer cross-sectional dimension of the screw cap is bigger than that of the tubular end portion of the feed pipe itself. In fact, the outer cross-sectional dimension of the screw cap is twice as big as that of the tubular end portion of the feed pipe. The outer cross-sectional dimension of the arrangement in accordance with the present invention is stipulated only by the outer cross-sectional dimension of the tubular end portion of the feed pipe which is only 14 mm, if it is desirable to discharge liquid medium under a high pressure of many thousand bars. The arrangement with such a small outer cross-sectional dimension may in a very simple, fast and reliable manner be located immediately adjacent to the cutting edge of the cutting tool (i.e., chisel) or even further towards the surface to be cut in a direction of the liquid medium jet. In this case the arrangement may be installed right on the chisel so as to be very close to the surface to be cut.

It is true that the front part of the tubular end portion of the feed pipe becomes slightly weakened due to provision of the circumferential recess on the inner circumference of the feed pipe and due to provision of the inner thread on the inner circumference of the tubular end portion of the feed pipe. However, such a weakening is entirely compensated for by the wall thickness of the jet support and the jet holder when the jet support is screwed in the tubular end portion of the feed pipe. Therefore, it becomes unnecessary to increase the wall thickness of the front part of the tubular end portion of the feed pipe.

Another advantageous feature of the present invention resides in the fact that the task of sealing the jet means in the tubular end portion of the feed pipe against the liquid medium under extremely high pressure is solved in a very simple and reliable manner. The leading end portion of the jet support engages along the outer cylindrical smooth surface with the corresponding cylindrical inner surface of the tubular end portion of the feed pipe without any radial clearance whatsoever. The liquid medium flowing within the interior of the jet support under extremely high pressure acts upon the inner surface of the jet support causing slight elastical expansion of the cylindrical wall of the jet support radially and outwardly against the inner surface of the tubular end portion of the feed pipe. In other words the high pressure of the liquid medium additionally urges the jet support radially and outwardly into engagement with the inner surface of the feed pipe, thereby increasing the sealing effect of the leakage-free sealing connection between the outer surface of the leading end portion of the jet support and the inner surface of the tubular end portion of the feed pipe. Such a sealing connection advantageously does not require any additional sealing means.

In order not to impair the self-sealing effect of the leading end portion of the jet support it is advisable to screw the jet support all the way into the tubular end portion of the feed pipe until the leading end face of the jet support abuts the inner circumferential shoulder. However, it is preferable to screw the jet support axially into the feed pipe without any initial stress (i.e., tension) nevertheless without any axial clearance either.

In accordance with the preferred embodiment of the present invention the funnel-shaped recess in the leading end portion of the jet support has an inclined inner surface, which inclination relative to the cylindrical outer surface constitutes somewhat from 3° to maximum 10°. This inclination preferably constitutes 5°. Such an inclination ensures that the leading end of the wall of the jet support is so thin that under the high pressure of the liquid medium the leading end portion of the jet support is pressed against the inner surface of the tubular end portion of the feed pipe to thereby guarantee a sufficiently reliable self-sealing contact between the jet support and the feed pipe. The inner configuration of the funnel-shaped recess may be wedge-like or may be slightly deviated from the wedge-like form. The inner configuration may for example have a slightly concaved shape. This is done so as to maintain the wall thickness of the leading end portion of the jet support along relatively large length at a level sufficient to elastically expand under the extremely high pressure of the liquid medium, to thereby ensure the self-sealing connection between the jet support and the tubular end portion of the feed pipe.

In accordance with the preferred embodiment of the present invention the jet support is of one piece.

However, it is possible to insert in the tubular end portion of the feed pipe axially one after another two separate parts which together constitute the jet support. In this case, the first part to be inserted (i.e., leading end portion) into the feed pipe has the outer smooth cylindrical surface which engages the inner cylindrical surface of the feed pipe without any radial clearance. The end face of the first part abuts the inner annular circumferential shoulder. The first part is provided with the inner funnel-shaped recess which converges towards the open end of the feed pipe, that is the recess broadens towards the inner annular circumferential shoulder on the inner surface of the feed pipe. The second (i.e., trailing end) part to be inserted into the feed pipe has the outer thread portion which is engageable with the corresponding thread provided on the inner surface of the tubular end portion of the feed pipe. The first part provided with the funnel-shaped inner recess serves as an additional sealing arrangement. In order to increase the sealing effect the outer cylindrical surface of the first part is provided with a circumferential groove which receives a sealing washer. Obviously, there might be provided a plurality of such sealing washers. In this case the inclination of the inner wall of the first part relative to the outer cylindrical surface may be 10°.

Two separate parts of the jet support contact each other along respective conical end face surfaces provided on the trailing end of the first part and on the leading end of the second part correspondingly. Such a connection guarantees the central orientation of these parts relative to each other, so that the projecting conical end face of the second part provided with the outer thread portion engages the inwardly directed conical end face of the first part which engages the inner cylindrical smooth surface of the feed pipe without any radial clearance. It is advantageous to install at least one additional sealing ring between these conical end faces of the first and second parts respectively. Preferably, this additional sealing ring is so located as to engage on the one hand both conical surfaces of the first and second parts and on the other hand simultaneously engage the inner surface of the tubular end portion of the feed pipe.

In order to withdraw any liquid medium which somehow gets past the seals the tubular end portion of the feed pipe is provided between the inner thread portion thereof and the cylindrical portion thereof with a radially outwardly extending throughgoing hole which is operative to guide the liquid medium outside away from the tubular end portion of the feed pipe.

The trailing end portion of the jet support, in accordance with the preferred embodiment of the present invention, is provided at the end thereof with an outer element. The outer element extends beyond the tubular end portion of the feed pipe. The outer element constitutes a hexagon bolt which is operative for gripping when it is necessary to insert (or withdraw) the jet support in (or from) the tubular end portion of the feed pipe. The outer element may have the outer cross-sectional dimension bigger than that of the jet support but by no means bigger than that of the tubular end portion of the feed pipe (e.g., the preferred embodiment teaches the outer cross-sectional dimension of the outer element equal to that of the tubular end portion of the feed pipe).

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
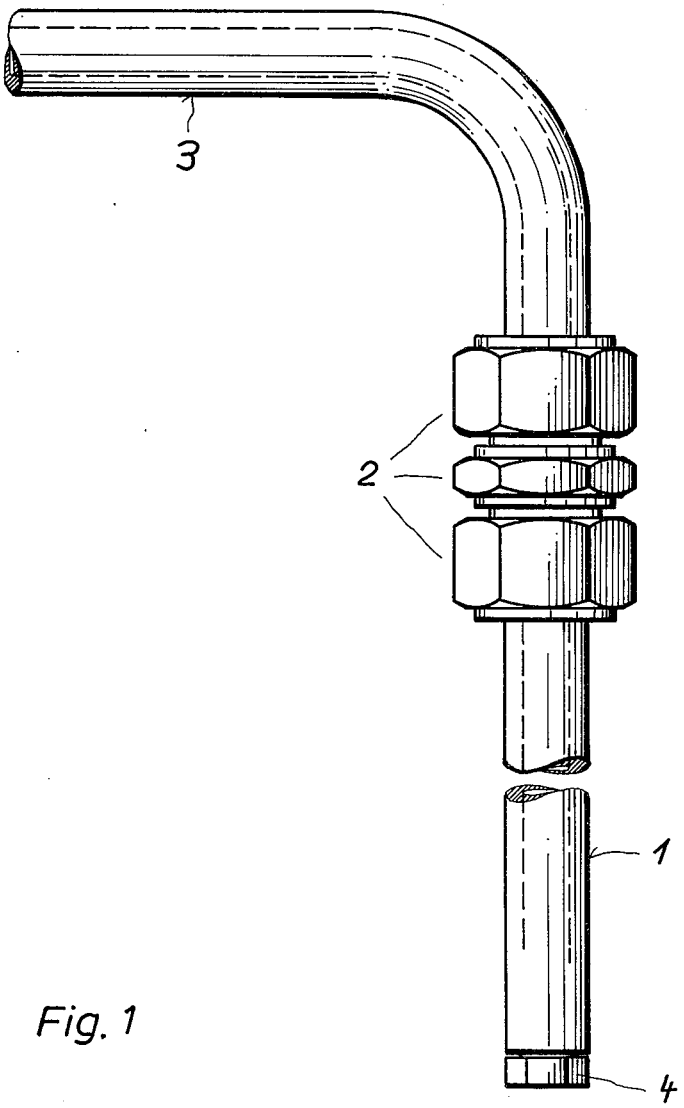
FIG. 1 is a view showing an arrangement for discharging liquid medium under a high pressure from a feed pipe, in accordance with the present invention.
Figure 3:
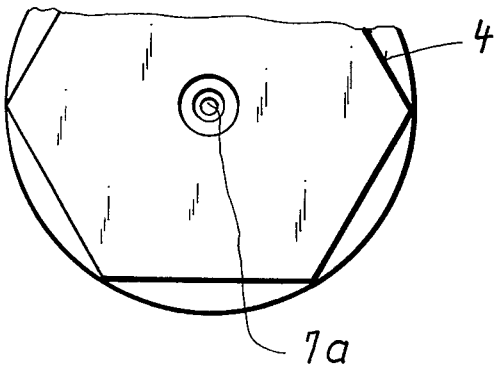
FIG. 3 is a bottom view at the arrangement shown in FIG. 2.
Figure 5:
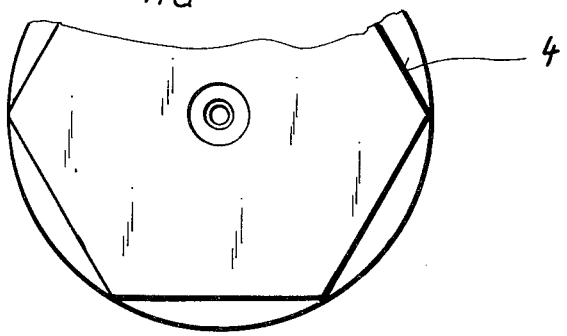
FIG. 5 is a bottom view at the arrangement shown in FIG. 4.

Referring now to the drawings and first to the FIG. 1 thereof, it may be seen that the reference numeral 1 designates a feed pipe. The upper end of the feed pipe 1 is connected via a connecting unit 2 with a connecting tube 3 which may be connected with the liquid medium (i.e. water) reservoir (not shown). The feeding pipe 1 may be very easily disconnected from the connecting tube 3. The connecting tube 3 supplies water via the connecting unit 2 into the feed pipe 1. The lower tubular end portion of the feed pipe 1 is provided with an outer element 4 which is connected to a jet support (not shown in FIG. 1) which is inserted in the tubular end portion of the feed pipe 1. The outer element 4 is shaped as a hexagon bolt (see FIGS. 3 and 5) which is operative as a grip when it is necessary to insert (or withdraw) the jet support in (or from) the interior of the tubular end portion of the feed pipe 1.

Figure 2:
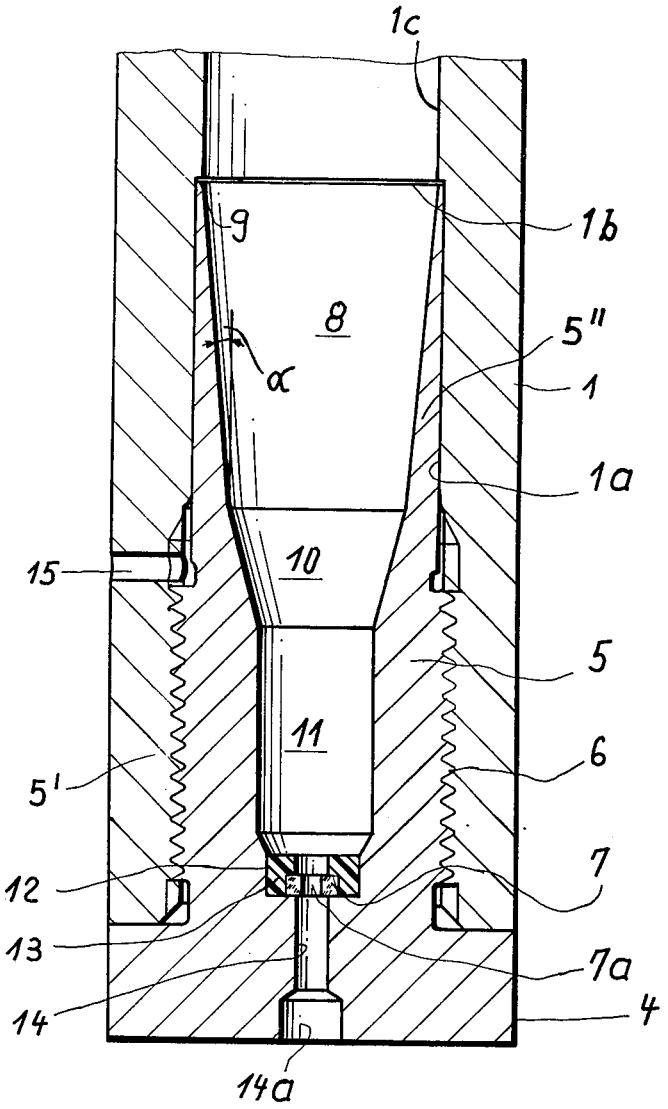
FIG. 2 is a longitudinal sectional view taken through a tubular end portion of the feed pipe with the arrangement for discharging liquid medium under a high pressure, shown in an enlarged scale of 5:1.

FIG. 2 shows a front tubular end portion of the feed pipe 1 with a jet support 5 inserted in the tubular end portion of the feed pipe 1. The jet support 5 includes a portion 5' which is integrally connected to the hexagon bolt 4. The portion 5' is provided with an outer thread 6. The jet support 5 is further provided with a portion 5'' which is integrally connected with the portion 5'. The portion 5'' has the outer smooth cylindrical surface which is axially received along a corresponding smooth cylindrical inner circumference 1*a* of the tubular end portion of the feed pipe 1. It is to be noted that the cylindrical portion 5'' is received in the tubular end portion 1*a* of the feed pipe 1 without any radial clearance whatsoever. FIG. 2 shows that the portion 1*a* of the feed pipe 1 has relatively bigger cross-sectional dimension than that of the portion 1*c* which is located upstream of the feed pipe 1. Between the portion 1*c* and the portion 1*a* of the feed pipe 1 there is arranged an inner annular circumferential shoulder 1*b*. The jet support 5 is screwed all the way into the tubular end portion of the feed pipe 1 until the front end face of the jet support 5 abuts the inner annular circumferential shoulder 1*b*.

The portion 5' of the jet support 5 is provided with a jet 7 inserted into a jet holder 13 which in its turn is fixed in a recess 12 of the jet support 5. The portion 5'' is provided with an inner funnel-shaped recess 8 which converges towards the portion 5', that is towards the jet 7. The wall thickness of the portion 5'' is relatively small especially at the region of the inner annular shoulder 1*b*. At this region the portion 5'' has only a thin ring 9 which is almost entirely received in the recess on the surface 1*a* constituted by the shoulder 1*b*. The ring surface 9 may be very slightly spaced from the corresponding surface of the shoulder 1*b*.

The funnel-shaped recess 8 constitutes lengthwisely of the elongation of the jet support 5 an inclination angle $\alpha$ between the inclined inner surface of the portion 5'' and the outer cylinderical surface thereof. The angle $\alpha$ is equal to 5°. The wall of the portions 5'' has at least at the end portion thereof a very small thickness, so that this wall is slightly expanded (i.e. pressed) radially and outwardly towards and against the inner surface of the tubular end portion 1*a* of the feed pipe 1 under a hydraulic pressure of the water passing through the feed pipe 1 and the jet support 5 under an extremely high pressure. Such an expansion ensures that the portion 5'' sealingly contacts the inner surface 1*a* of the feed pipe 1, so as to eliminate any leakage of water between the portions 5'' and the feed pipe 1.

The inner configuration of the inner surfaces of the recess 8 may be shaped differently from that shown in FIG. 2. The inner surfaces of the recess 8 may be for example slightly concaved (see FIG. 4), that is recessed inwardly towards the outer cylindrical surface of the portion 5'', in other words in a direction so as to decrease the wall thickness of the portions 5'' of the jet support 5.

The recess 8 communicates with a passage 10 which has a relatively higher inclination towards the jet 7. The passage 10 transits into a substantially cylindrical passage 11 which in its turn transits via a conical transition into the cylindrical recess 12 which receives the jet holder 13 of synthetic plastic material. The holder 13 receives the jet 7 of sapphire or diamond. The jet 7 has a plate-shaped cross-section. The jet 7 is sealingly received in the recess 12 of the jet holder 13 which is preferably made of tetrafluoroethylene (Teflon). The jet 7 has a throughgoing passage 7*a* which in the preferred embodiment is equal to 0.3 mm in diameter. The passage 7*a* communicates with a broadened channel 14 which in its turn communicates with a further broadened passage 14*a* communicating with the exterior of the feed pipe 1.

Between the thread portion 6 of the tubular end portion of the feed pipe 1 and the cylindrical portion 1*a* thereof there is provided a throughgoing passage 15 (see FIG. 2). The passage 15 connects the interior of the feed pipe 1 with the exterior thereof so as to permit withdrawing of the liquid medium from the space between the jet support and the inner circumference of the tubular pipe end portion via a hole extending radially in the tubular end portion intermediate the inner thread and the inner surface of the tubular pipe end portion. In order to change the jet 7, or for any other reason, the jet support 5 may be very easily withdrawn from the feed pipe 1. This can be done by means of the hexagonal bolt 4 which is gripped by an operator so as to unscrew the jet support 5 with the jet holder 13 from the feed pipe 1.

The wall of the portion 5'' of the jet support 5 elastically expands under the high pressure of the water passing through the feed pipe 1 and the jet 7 so as to guarantee sealing connection between the cylindrical outer surface of the portion 5'' and the cylindrical inner surface 1*a* of the feed pipe 1.

Figure 4:
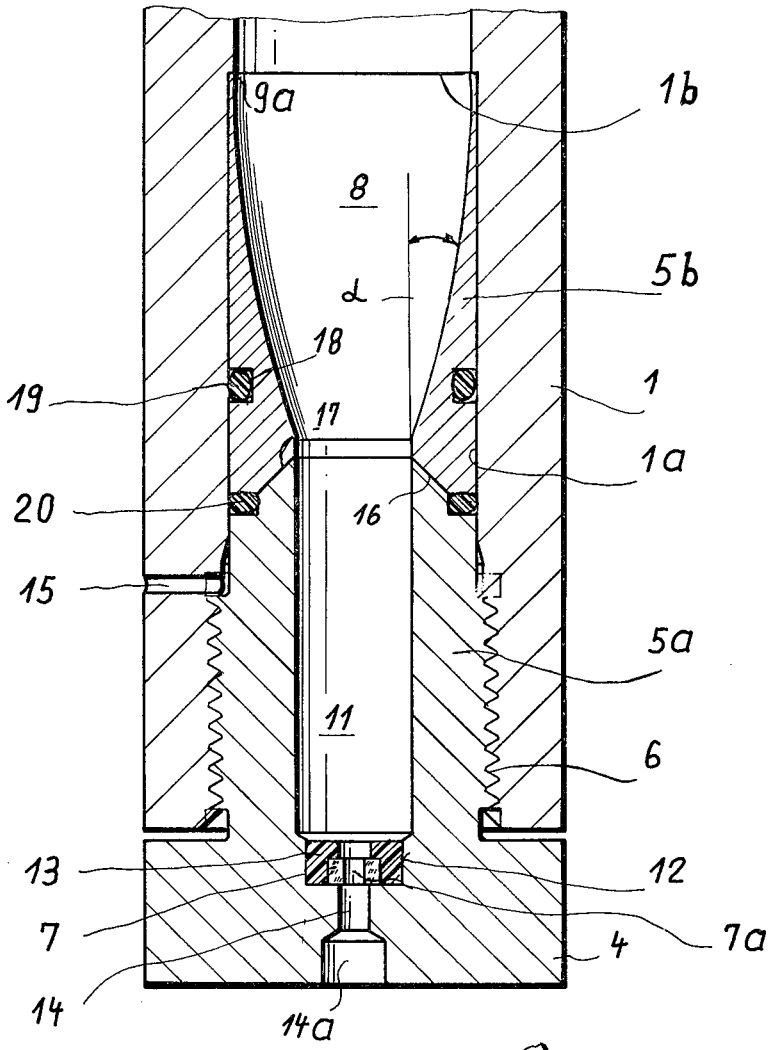
FIG. 4 is a longitudinal sectional view taken through a tubular end portion of the feed pipe with another embodiment of the arrangement, shown in an enlarged scale of 5:1.

FIG. 4 shows another embodiment of the arrangement in accordance with the present invention. The jet support shown in FIG. 4 comprises two separate parts 5*a* and 5*b*, which are inserted into the feed pipe axially one after another, that is the part 5*a* after the part 5*b*.

The part 5*a* is provided with the outer thread engageable with the inner thread 6 of the feed pipe 1. The part 5*a* is provided with the jet holder 13 which receives the jet 7. The part 5*b* is provided with the outer cylindrical surface and abuts with its end face ring-shaped surface 9*a* the annular inner shoulder 1*b* provided on the inner circumference of the feed pipe 1. The part 5*b* is provided with the inner recess 8 having a funnel-shaped cross-section similar to that shown in FIG. 2.

The parts 5*a* and 5*b* contact each other along the respective conical surfaces thereof, so as to center the parts 5*a* and 5*b* relative to each other. The part 5*a* has an outwardly projecting portion constituted by a circumferential surface 16 and the part 5*b* has an inwardly extending conical recess with a corresponding conical surface 17. The outwardly projecting portion of the part 5*a* is received along the surface 16 thereof in the inwardly extending recess of the part 5*b* along the corresponding surface 17 thereof.

Thus, the part 5*b*, having the funnel shaped recess 8, constitutes simultaneously a sealing ring. In order to facilitate the sealing functions of the part 5*b* the outer surface thereof is provided with the circumferential groove 18 which receives therein the sealing ring 19. Another sealing ring 20 is received between the corresponding conical surfaces 16 and 17 of the parts 5*a* and 5*b*, respectively, so that the ring 20 simultaneously contacts the surfaces 16 and 17 and the inner cylindrical surface 1*a* of the feed pipe 1.

In the case of the embodiment shown in FIG. 4 the inclination angle $\alpha$ between the inner inclined (concave) surface of the part 5*b* and the outer cylindrical surface thereof is substantially equal to 10°, which fact facilitates the elastical expansion of the wall of the part 5*b* under the extremely high pressure of the water passing through the feed pipe 1 and the jet 7.

It is to be understood that the sealing rings 19 and 20 only additionally support the main sealing ring (i.e., the part 5*b*) and principally speaking they can be omitted without impairing the sealing conditions of the arrangement.

It will be understood that each of the elements described above, or two or more together, may also find a useful application in other types of an arrangement for discharging liquid medium under a high pressure differing from the types described above.

While the invention has been illustrated and described as embodied in an arrangement for discharging liquid medium under a high pressure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for discharging liquid at a predetermined high pressure level from a feed pipe having a tubular end portion, comprising jet means adapted to be installed in the tubular end portion of the feed pipe and including a jet, a holder for the jet and a support for the holder and having a first portion and an axially spaced second portion adapted to be located inside said tubular end portion and having a smooth outer cylindrical circumference engageable with a corresponding inner circumference of said tubular end portion substantially without any radial clearance therebetween, said jet means further including an inlet, an outlet spaced from said inlet and passage means connecting said inlet with said outlet and including an inner recess provided in said second portion of said holder and having a funnel-shaped cross section converging in direction towards said first portion so as to increase the pressure of incoming liquid up to said predetermined level as the medium issues through said outlet; and connecting means for sealingly and detachably installing said jet means in said tubular end portion, including an outer thread provided in said first portion of said support and engageable with a corresponding inner thread in said tubular end portion of said feed pipe.

2. An arrangement as defined in claim 1, wherein said second portion has a circumferential wall having said outer cylindrical surface and an inner surface converging towards said first portion so that the thickness of said circumferential wall increases from an end face of said second portion in said direction towards said first portion.

3. An arrangement as defined in claim 2, and further comprising means for preventing an undesired further axial movement of said jet support into said tubular end portion when said jet support is inserted into said tubular end portion until a predetermined level.

4. An arrangement as defined in claim 3, wherein said preventing means include said end face of said second portion adapted to engage an inner annular shoulder provided on the inner circumference of said tubular end portion at said predetermined level so that when said end face engages said inner annular shoulder any further axial movement of the jet support into the feed pipe is eliminated.

5. An arrangement as defined in claim 4, wherein said jet support engages with said end face thereof said annular inner shoulder substantially axially clearance free.

6. An arrangement as defined in claim 5, wherein said wall is so shaped and dimensioned as to permit an elastical expansion thereof under pressure of the liquid medium flowing through the arrangement, so that said wall expands radially and outwardly and further into sealing contact with said inner circumference of said tubular end portion.

7. An arrangement as defined in claim 6, wherein said second portion has an axially decreasing wall thickness, to thereby provide said wall with such a thickness as to permit the elastic expansion of the same.

8. An arrangement as defined in claim 7, wherein said inner surface of said second portion is radially outwardly concaved.

9. An arrangement as defined in claim 8, wherein said jet support is of one piece.

10. An arrangement as defined in claim 8, wherein said jet support is of at least two separate pieces inserted into said tubular end portion one after another.

11. An arrangement as defined in claim 10, wherein said jet support has a first piece constituting said first portion and having said outer thread for connecting to said inner thread on said inner circumference of said tubular end portion, and a second piece constituting said second portion and having said outer cylindrical surface engaging the corresponding inner cylindrical surface of said tubular end portion.

12. An arrangement as defined in claim 11, wherein said first piece is provided with said jet holder receiving said jet.

13. An arrangement as defined in claim 12, wherein said second piece is further provided with said inner recess having said funnel-shaped cross section converging towards said first piece.

14. An arrangement as defined in claim 13, wherein said second piece is further provided with said end face for axially engaging said inner annular shoulder.

15. An arrangement as defined in claim 14, and further comprising means for connecting said first and second pieces, said second piece being adapted to be inserted first into said tubular end portion, said first piece being screwed into said tubular end portion thereafter so as to axially displace said first piece via said connecting means until said first piece abuts with said end face thereof said inner annular shoulder provided on the inner circumference of said tubular end portion.

16. An arrangement as defined in claim 15, wherein said first piece has first trailing and leading end faces and said second piece having a second trailing end constituting said end face of said second piece and a second leading end face axially spaced from said second trailing end face in the direction towards said first piece, said connecting means including said first trailing end face of said first piece and said second leading end face of said second piece connectable with said first end face when said pieces are in engagement with one another inside said tubular end portion.

17. An arrangement as defined in claim 16, wherein said first trailing end face constitutes a conical surface of said first piece, projecting therefrom inwardly into said tubular end portion, said second leading end face including a conical recessed surface of said second piece extending futher inwardly in said tubular end portion and away from said first piece, said conical recessed surface of said second piece being operative for engaging said conical projecting surface of said first piece when said pieces are inserted into said tubular end portion one after another.

18. An arrangement as defined in claim 17, and further comprising additional sealing means for sealing said second piece inside the tubular end portion.

19. An arrangement as defined in claim 18, wherein said additional sealing means include a circumferential groove provided on the outer cylindrical surface of said second piece, and a sealing ring received in said groove and sealingly contacting said inner circumferential surface of said tubular end portion.

20. An arrangement as defined in claim 19, wherein said additional sealing means include another sealing ring received between said conical surfaces of said first and second pieces for sealing contacting said inner circumferential surface of said tubular end portion.

21. An arrangement as defined in claim 17, and further comprising means for withdrawing liquid medium from a space between said jet support and said inner circumference of said tubular end portion.

22. An arrangement as defined in claim 21, wherein said withdrawing means include a throughgoing hole extending radially in the tubular end portion of said feed pipe, said hole being located between said inner thread and said inner cylindrical surface of said tubular end portion.

23. An arrangement as defined in claim 2 wherein said inner surface of said second portion includes with said outer cylindrical surface thereof an angle.

24. An arrangement as defined in claim 23, wherein said angle is 5°.

25. An arrangement as defined in claim 1, and further comprising gripping means for gripping said jet means when it is necessary to displace the same relative to said tubular end portion.

26. An arrangement as defined in claim 25, wherein said gripping means have an outer element connected to said jet means and extending outwardly from said tubular end portion and radially accessible from the outside of the latter.

27. An arrangement as defined in claim 26, wherein said outer element is a hexagonal bolt.

* * * * *